US005934388A

United States Patent [19]

Mattson

[11] Patent Number: 5,934,388

[45] Date of Patent: Aug. 10, 1999

[54] METHOD FOR MEASUREMENT OF THE AIR FLOW IN ROCK DRILL BITS

[75] Inventor: Michael Mattson, Sandviken, Sweden

[73] Assignee: Sandvik AB, Sandviken, Sweden

[21] Appl. No.: 08/884,388

[22] Filed: Jun. 27, 1997

[30] Foreign Application Priority Data

Jun. 27, 1996 [SE] Sweden ..... 9602544

[51] Int. Cl.[6] ..... C09K 7/00

[52] U.S. Cl. ..... 175/48; 175/40

[58] Field of Search ..... 175/40, 48; 73/152.18, 73/152.19, 152.21, 152.29, 861.65

[56] References Cited

U.S. PATENT DOCUMENTS 4,754,818 7/1988 Wood ..... 175/48

*Primary Examiner*—Tamara Graysay
*Assistant Examiner*—Sunil Singh
*Attorney, Agent, or Firm*—Burns, Doane, Swecker & Mathis, L.L.P.

[57] ABSTRACT

The air flow rate through a rock drill bit is measured while the drill bit is connected to a drill string. A tube of a manometer is inserted into a channel of the drill bit while an air flow is conducted through the drill string and channel, whereby the manometer measures a pressure of the air flow in the channel. From that measurement, a nominal air flow rate is calculated. The nominal air flow rate is corrected as a function of at least one parameter selected from: a difference between a temperature of air entering the drill bit and a temperature of air ambient to the drill bit, and a height of the drill bit above sea level.

5 Claims, 4 Drawing Sheets

METHOD FOR MEASUREMENT OF THE AIR FLOW IN ROCK DRILL BITS

TECHNICAL AREA OF THE INVENTION

This invention relates to a method, in connection with rock drilling, for measuring an air flow through a rock drill bit of the type connected to an extensible drill string and comprising one or more nozzles and/or flush channels for air that is fed through the drill string and the drill bit from a compressor.

It is known to measure the pressure of the flushing air in a reference area, mathematically calculating a nominal value of the air flow rate on the basis of said measured pressure and to correct that nominal air flow value as a function of variable parameters, such as: a difference between a temperature of entrance air to the drill bit and a temperature of ambient air, and the height of the drilling site above sea level.

Often also the air flow rate between the drill string and the bore wall is calculated mathematically as a function of the corrected flushing velocity, which flow rate is compared with established values of a requisite force to lift the dust (i.e., cuttings) to the ground surface.

BACKGROUND OF THE INVENTION

During the drilling of blast holes (for example at a depth of 15–30 m) often rotary drill bits are used, which work with pressurized air as flushing medium. A primary object for the flushing air is to lift the drill cuttings crushed by the drill bit, from the drilled hole. That is done by blowing air out through one or more nozzles terminating downwards in the drill bit the nozzles having a comparatively large diameter (for example 8–26 mm). Thereafter, the air is forced to rise up through the drilled hole at a fairly high speed. Another object of the flushing air is to cool the bearings for the hubs which are included in the drill bit, and to keep these bearings clean. To this end, each of the so-called legs of the drill bit on which the hubs are mounted, includes channels which terminate in areas of the bearings and through which a certain amount of the flushing air is conveyed from the main air flow through the drill bit. In order to obtain good drilling results it is vital that the air flow rate through the drill bit and the drilled hole be optimally adjusted for each individual case. This rate depends on many different variable factors and must therefore be controlled at repeated occasions during each individual drilling work. Some minerals can give coarse and heavy drill cuttings, which require a very high flow rate (for example about 50 m/s) to be lifted up from hole, while other minerals give fine-grained and light drill cuttings which require a considerably more moderate flow rate (for example about 25 m/s). The rate should on the other hand not be too high, since then abrasive damage to different components in the drill bit may occur. Usually the compressor capacity deteriorates with increasing life. For that reason it is not practically possible to rely on nominal ratings for the compressor when the real flow rate is assessed. It is consequently necessary to determine the flow rate in each individual case in accordance with the previously described prior art.

PRIOR ART

In previously known methods for air flow determination, a particular measuring set has been used, which includes a measuring tube as a main component, which can be connected to drill strings with different diameters via particular adapters. More exactly, the measuring tube can be connected to the drill string first when the drill bit has been removed from the string, wherein a fitting adapter first is placed on the drill string, whereafter the measuring tube is firmly screwed into the adapter. The measuring tube is either directly, or indirectly via hoses, connected to a manometer by which the air pressure inside the tube can be detected. In the measuring set there is provided a variety of interchangeable additional discs with different holes, whose cross-sectional areas correspond to the total cross-sectional areas of the nozzles and/or bearing flush channels which are included in different drill bits. The holes of the additional discs form in this manner a reference area which is characteristic of different types of drill bits and of different nozzles to one and the same drill bit. After the pressure over this reference area has been measured the measuring tube is removed from the adapter and the adapter is removed from the drill string. In a final step the drill bit is mounted on the drill string, whereafter the drilling work can be resumed. Such measurement of the flushing velocity is in practice performed frequently in connection with removing the drilling equipment from a finished hole to a new heading.

A definite drawback, however, with the above mentioned measuring method is that the measuring operation takes not less than 1–2 hours. Such a long down time means that the expensive drilling equipment as well as manpower is utilized in a economical ineffective manner. Since personnel generally regards the measurement work only as a necessary evil there is a risk of negligence in case that control measurements are made too seldom. This can in its turn lead to bad drilling results in both economical and technical terms.

To measure pressure directly in a drill bit is previously known per se through U.S. Pat. No. 4,754,818 without removing the bit from the drill string and without exchanging the bit for a measuring device. In the known method, however, only one measurement is performed, namely one absolute pressure measurement without regard for different variable parameters and their influence on air flow. Furthermore, the known measurement is conducted by means of a manometer device that requires removal of a plug and mounting of an adapter. Operations to assemble and reassemble such threaded components are very awkward and time-consuming.

OBJECTS AND FEATURES OF THE INVENTION

An object of the present invention is to eliminate the above-mentioned drawbacks and to create an improved method for air flow determination in connection with rock drilling drill bits.

Another object is to achieve a quick and efficient measurement of pressure in a reference area of the drill bit to enable a quick measurement of the actual air flow rate through the drill bit to be determined.

These and other objects are achieved by the present invention which relates to a method for measuring an air flow through a rock drill bit while the rock drill bit is connected to a drill string. The method comprises the steps of:

A) providing a narrow tube connected to a manometer;

B) inserting the tube into a channel of the drill bit while conducting an air flow through the drill string and channel, whereby the manometer measures a pressure of the air flow through the channel;

C) calculating a nominal air flow rate on the basis of the pressure measured in step B; and D) correcting the nominal air flow rate calculated in step C, as a function of at least one parameter selected from: temperature of air entering the drill bit, temperature of air ambient to the drill bit, and a height of the drill bit above sea level.

BRIEF DESCRIPTION OF THE DRAWINGS

The objects and advantages of the invention will become apparent from the following detailed description of a preferred embodiment thereof in connection with the accompanying drawing in which like numerals designate like elements and in which.

DETAILED DESCRIPTION OF A PREFERRED EMBODIMENT OF THE INVENTION

Figure 1:
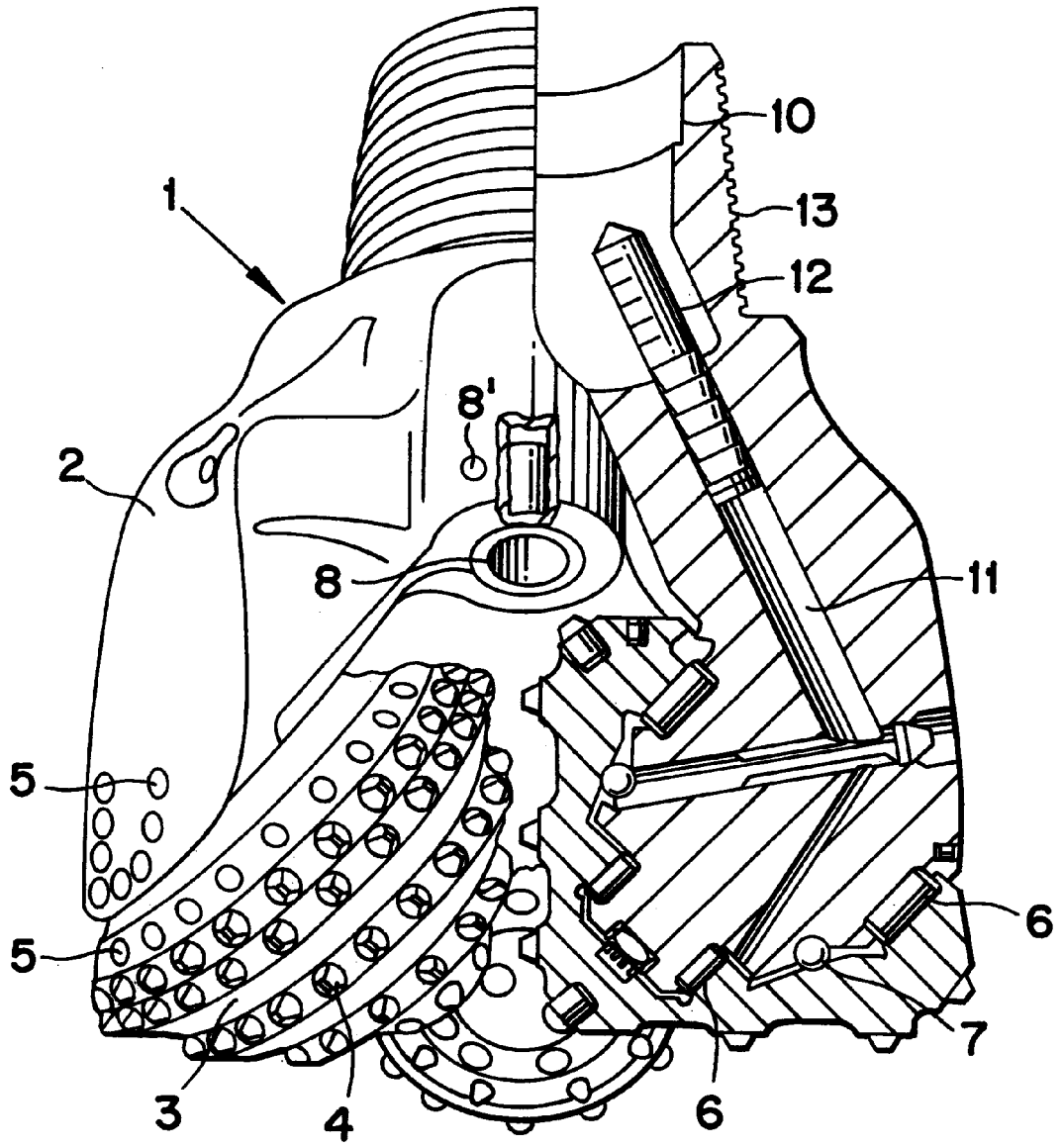
FIG. 1 is a partly broken-away perspective view showing a conventional rotary drill bit.

A rotary drill bit shown in FIG. 1 comprises a body 1 which includes three legs 2 each carrying a conical hub 3 equipped with cutting inserts 4. Furthermore, wear protection means or wear pads 5 with large resistance against abrasion are applied on the hub and on the surfaces of the legs 2. The individual hub 3 is rotatably journaled relative to the leg 2 via roller bearing means and ball bearing means 6, 7, respectively. A main nozzle 8 is included in each leg 2 and has a comparatively large diameter. Via a branch channel 9, the nozzle communicates with a main channel 10 common to all branch channels. Furthermore, a somewhat more narrow branch channel 11 is included in each leg, which is connected to a number of still narrower channels that may conduct flushing air to the different bearings for the purpose of cooling and rinsing these bearings. A filtering means 12 is provided in the branch channel 11. On the surface of the tubular neck which delimits the main channel 10, a male thread 13 is formed to enable the drill bit to be connected to a drill strings.

The nozzle 8 consists of a ring which is releasably mounted in the area of the orifice of the branch channel 9, said ring being held in place with the aid of an appropriate locking means 8', e.g., a screw. An entire series of nozzle rings with different internal diameters are associated with the drill bit. In practice, the smallest nozzle diameter is 8 mm and the biggest diameter is 26 mm. The difference in diameter between different rings is generally 1.5 to 2 mm (the next smallest nozzle has in this manner a diameter of 9.5 mm, the next nozzle a diameter of 11 mm, etc.).

Figure 2:
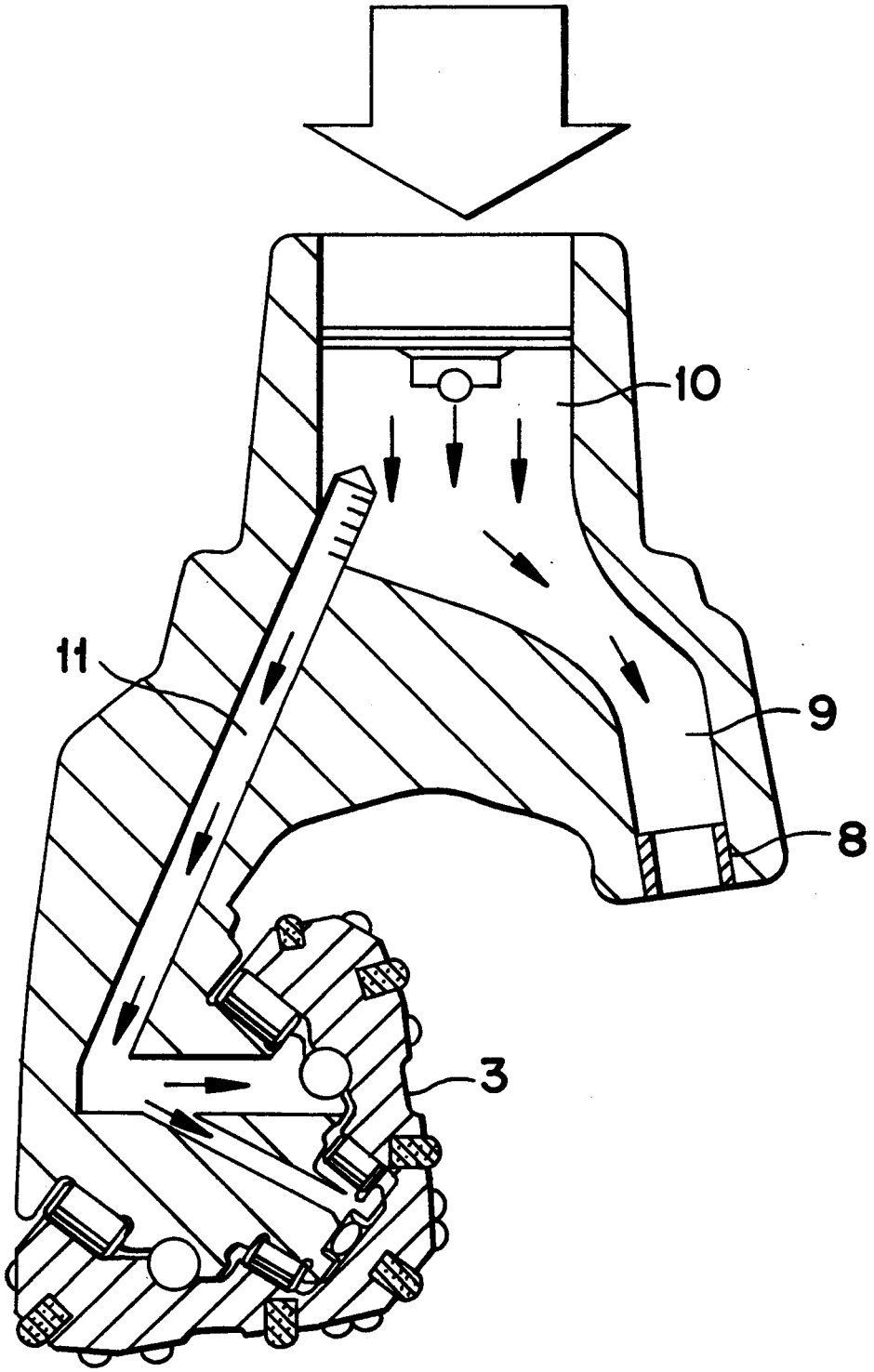
FIG. 2 is a longitudinal section through a leg of a drill bit shown in to FIG. 1.

As is illustrated by the arrows in FIG. 2 two branch flows for each of the three legs of the drill bit are conveyed from the greater main entrance channel 10, namely a relatively great flow through the branch channel 9 and nozzle 8, as well as a smaller flow via the branch channel 11 to the bearings of the hub.

As thus far described, the rotary drill bit is conventional. As described earlier herein, a known technique for air flow measurement has required that the drill be removed from the drill string and replaced by a particular measuring tube provided with an additional disc having a hole, which tube serves as a reference area substantially corresponding to the total cross-sectional area of the nozzles of the drill bit and the flush channels.

The present invention is based on a combination of two features which replace the prior art measuring tube, namely: (i) utilizing the drill bit itself and its nozzles and channels, respectively, as a reference area, and (ii) measuring the pressure with a measurement means which can be inserted into a nozzle of the drill bit without considerably disturbing an air flow through the drill bit.

The first mentioned feature is performed already in connection with the manufacture of the drill bit and the associated set of nozzles. That is, the nominal air flows which are obtained for the different nozzles 8 are measured (in laboratory) for the individual drill bit, all from the smallest nozzle to the greatest, as well as the total pressure in these nozzles and in the flushing channels 11. The measurement results of the air flows and pressure measured in this manner are applied as characteristic ratings for this individual type of drill bit.

Figure 3:
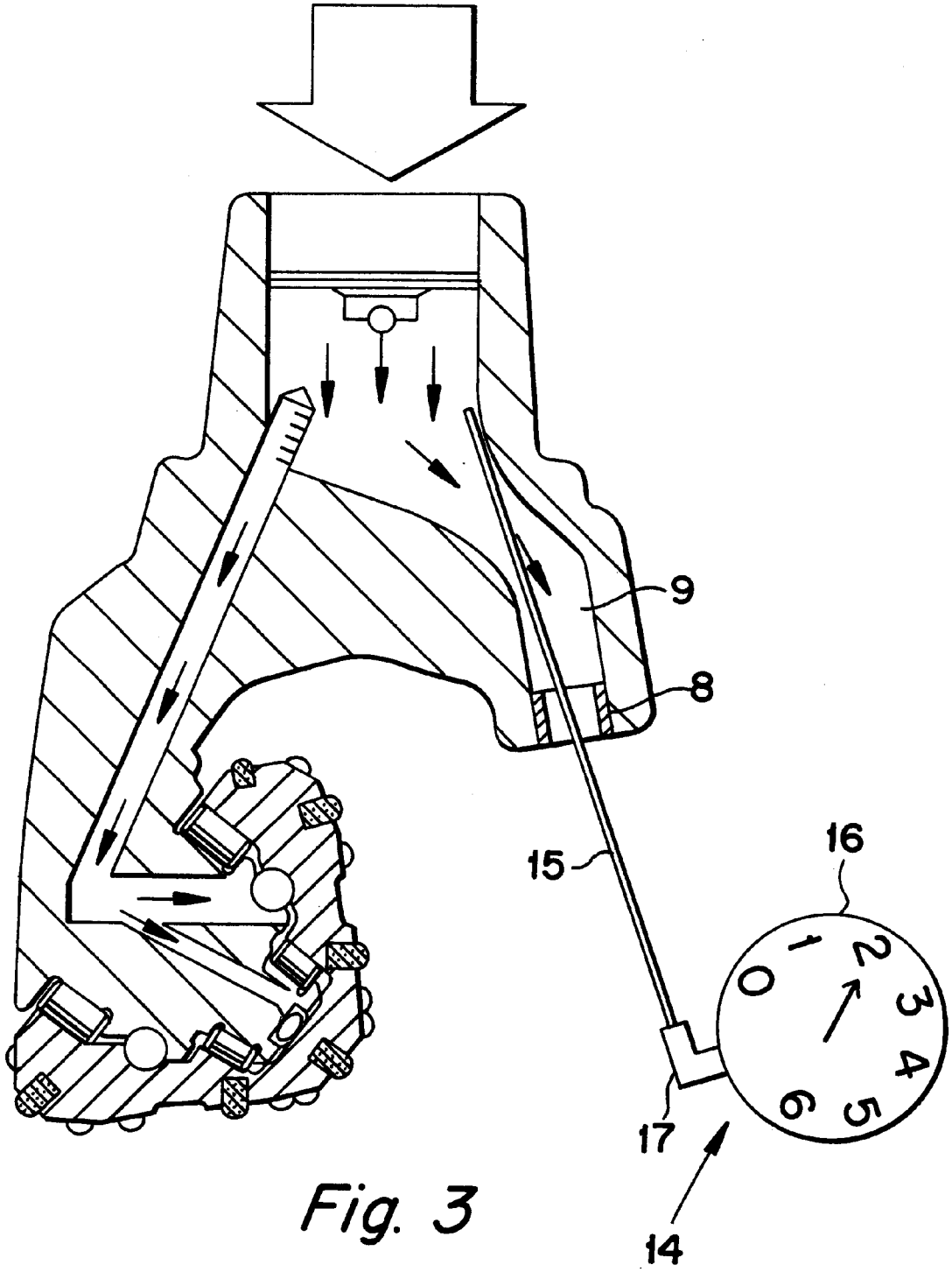
FIG. 3 is a view similar to FIG. 2 showing a measurement means inserted in a nozzle in the conventional drill bit according to the present invention.
Figure 4:
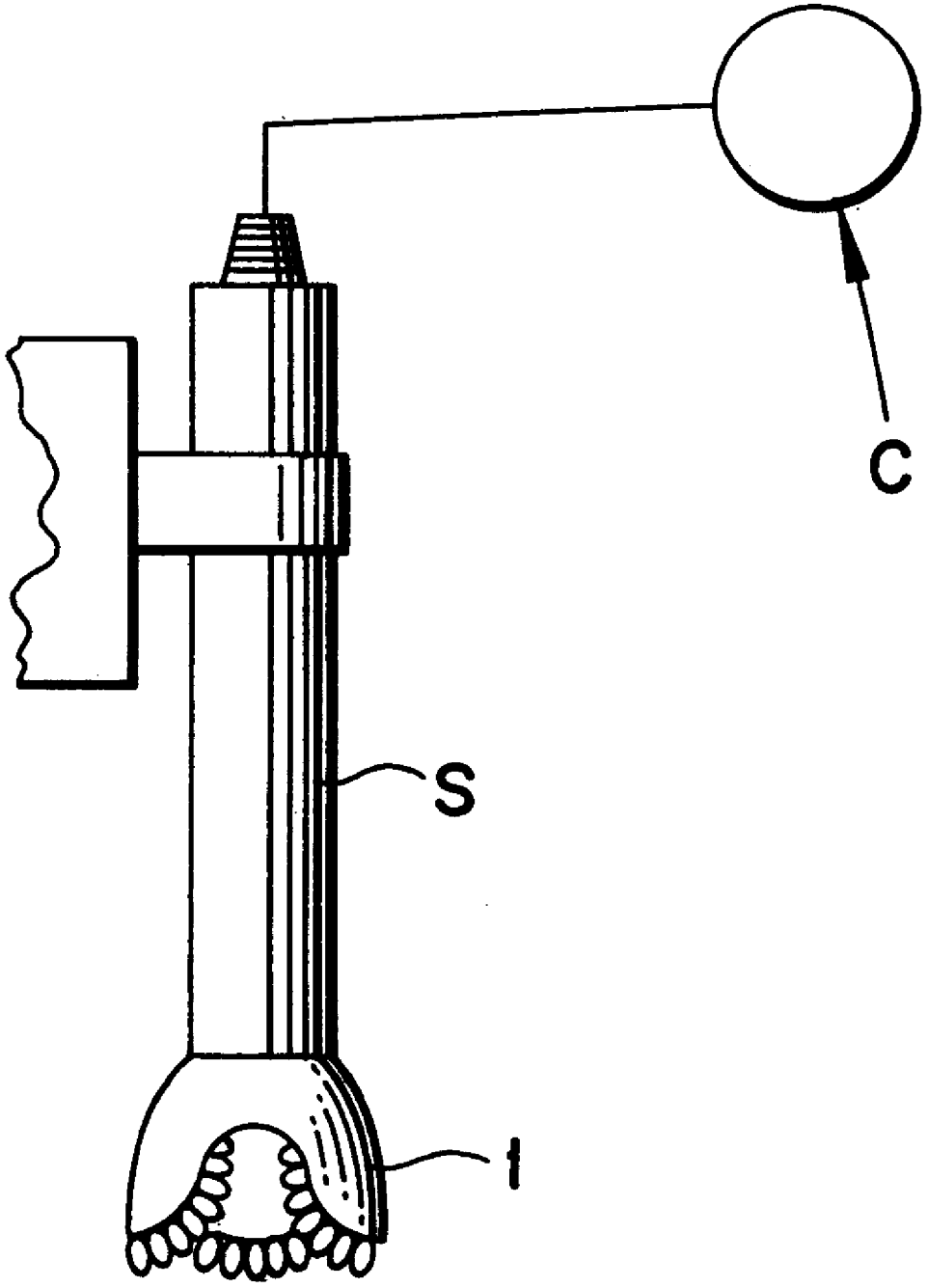
FIG. 4 is a schematic side elevational view of a drill bit and drill string when the flow rate through the drill bit is being measured.

The second feature consists in measuring the pressure directly in the drill bit, more exactly with the aid of a simple measurement means 14 of the type shown in FIG. 3. Characteristic for this measurement means is that it comprises an elongated tube 15 which communicates with a manometer 16. In the schematically shown embodiment the tube 15 is directly connected to the manometer via a bent pipe 17. In practice the tube suitably has, an outer diameter in the range of 3–5 mm and a wall thickness of about 0.5 mm. In one preferred embodiment the tube has an outer diameter of 4 mm and an inner diameter of 3 mm. During measurement, the measuring pipe 15 is inserted into the branch channel 9 through the nozzle 8 as an air flow from a compressor C is being supplied to the drill string S and the drill bit (see FIG. 4), such that the existing pressure in the flush channel propagates into the measuring pipe so that it can be directly detected by the manometer 16. Since the measuring pipe has a cross-sectional area which amounts to less than 25% of the cross sectional area of the smallest nozzle 8 (smallest diameter equals 8 mm), the measuring pipe will in practice occupy only a few percent (less than 5%) of the total air conveying cross-sectional area of the drill bit. In other words, the measuring pipe does not interfere in any substantial way with the total air flow through the drill bit.

At extremely high flow rates it can, for safety reasons, be appropriate to space the manometer from the drill bit. This can be done by securing the tube on the drill bit by means of a particular holder (not shown) which is connected to the manometer via a hose. In such a manner manometer can be read at a safe distance from the drill bit.

After the pressure in the drill bit has been measured in the above-mentioned manner (e.g., in mpa or bar), a nominal value of the air flow rate (i.e., volume per unit time) is mathematically calculated by a conventional method, based on the measured pressure, and this calculated nominal value for the air flow rate is corrected by considering different variable parameters. In particular, the temperature of the air entering the drill bit is measured (e.g., by inserting a thermometer through the nozzle 8 in the same manner as the manometer tube 15 is inserted in FIG. 3) as well as the ambient temperature of the drill bit environment, wherein the temperature difference can be used for modification of that nominal value via a conversion table. Another factor which requires that correction be made is the height above sea level (at greater height the air is thinner, implying that the compressor loses capacity). Finally the corrected value of the air flow is utilized to calculate the air flow rate (linear distance per unit time) between the drill string and the bore wall, which speed is compared with established values for force necessary to lift the dust.

A primary advantage with the invention is that the drill bit does not need to be removed from the drill string in connection with measurement. This means that the down time for the drilling equipment can be reduced to one or some minutes. A secondary advantage which follows on this short down time is that personnel can, without trouble, perform control measurements more often than was previously possible; something which, in turn, guarantees continuously favorable drilling results.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A method of determining an air flow rate through a rock drill bit, the rock drill bit including an air flow channel having at least one exit opening, the method comprising the steps of:

A) mounting a first nozzle of a first size in the exit opening of the rock drill bit;

B) conducting an air flow from a compressor through the flow channel while measuring the pressure and flow rate of the air flow;

C) replacing the first nozzle with a second nozzle of a second size different from the first size;

D) repeating step B with the second nozzle disposed in the exit opening;

E) determining a correlation between each measured air pressure and resulting air flow rate for each nozzle size for the rock drill bit;

F) employing a rock drill bit of the same type used in steps A–E in a drilling operation with the rock drill bit mounted on a drill string;

G) raising the rock drill bit from a hole being drilled;

H) conducting an air flow from a compressor through the rock drill bit while the rock drill bit remains attached to a portion of the drill string;

I) inserting a tube of a pressure sensor into the flow channel of the raised rock drill bit through the exit opening thereof to measure a pressure of the air flow inside the drill bit; and J) using the correlation determined in step E, determining an air flow rate on the basis of the pressure measured in step I.

2. The method according to claim 1 wherein step J includes providing corrected air flow rates as a function of at least one parameter selected from:

a difference between a temperature of air entering the rock drill bit and a temperature of air ambient to the rock drill bit, and a height of the rock drill bit above sea level.

3. The method according to claim 1 wherein step I includes providing a narrow tube having a cross-sectional area less than 5% of a total air-conveying cross-sectional area of the rock drill bit.

4. The method according to claim 1 wherein step I comprises providing a narrow tube having an outer diameter in the range of 3 to 5 mm.

5. The method according to claim 1 wherein step I comprises providing a narrow tube having an outer diameter of 4 mm.

* * * * *